US006758761B2

(12) United States Patent
Katsuya

(10) Patent No.: US 6,758,761 B2
(45) Date of Patent: Jul. 6, 2004

(54) SPORTS SWING TRAINING DEVICE

(76) Inventor: Toshinobu Katsuya, 10-28-905, Nishiokamoto 1-chome, Higashinada-ku, Kobe-shi, Hyogo 658-0073 (JP)

( * ) Notice: Subject to any disclaimer, the term of this patent is extended or adjusted under 35 U.S.C. 154(b) by 0 days.

(21) Appl. No.: 10/189,554

(22) Filed: Jul. 8, 2002

(65) Prior Publication Data

US 2003/0027656 A1 Feb. 6, 2003

(30) Foreign Application Priority Data

Jul. 31, 2001 (JP) ..... 2001-232330

(51) Int. Cl.[7] ..... A63B 69/36
(52) U.S. Cl. ..... 473/256; 473/224; 473/457
(58) Field of Search ..... 473/326, 333, 473/463, 457, 226, 219–256, 437; 446/419, 227, 404, 26, 267, 400, 402

(56) References Cited

U.S. PATENT DOCUMENTS 2,608,409 A * 8/1952 Pinkerton ..... 473/256
2,644,890 A * 7/1953 Hollihan ..... 250/462.1
2,950,115 A * 8/1960 Hurdzan ..... 473/234
3,037,775 A * 6/1962 Busch ..... 473/326
3,521,883 A * 7/1970 Hamilton ..... 473/437
3,971,559 A * 7/1976 Diforte, Jr. ..... 473/437
4,029,312 A * 6/1977 Wright ..... 482/108
4,260,150 A * 4/1981 Tabet ..... 473/437
4,330,121 A * 5/1982 McCafferty ..... 473/228
4,588,191 A * 5/1986 Stewart ..... 473/256
D286,556 S * 11/1986 Williams et al. ..... D21/408
5,064,197 A * 11/1991 Eddy ..... 473/326
5,178,392 A * 1/1993 Santioni ..... 273/153 R
5,263,713 A * 11/1993 Taylor et al. ..... 473/326
5,580,321 A * 12/1996 Rennhack ..... 473/234
5,613,916 A * 3/1997 Sommer ..... 473/332
5,776,009 A * 7/1998 McAtee ..... 473/333
5,803,829 A * 9/1998 Hayashi ..... 473/326
6,001,025 A * 12/1999 Blackmon ..... 473/256
6,010,415 A * 1/2000 Miggins ..... 473/437
6,019,687 A * 2/2000 Blowers ..... 473/326
6,302,813 B1 * 10/2001 Sturgeon et al. ..... 473/564
6,443,855 B1 * 9/2002 Tseng ..... 473/326
6,468,166 B1 * 10/2002 Spitzer ..... 473/241

* cited by examiner

*Primary Examiner*—Stephen P. Garbe
*Assistant Examiner*—Nini F. Legesse
(74) *Attorney, Agent, or Firm*—Ronald E. Greigg

(57) ABSTRACT

A sports swing training device comprising a grip, a shaft and a head used in practice of swing form of golf club or baseball or softball bat, wherein a hollow space is formed in the head and is partially filled with a liquid such as water or a solid material such as sand or small pellets.

3 Claims, 9 Drawing Sheets

SPORTS SWING TRAINING DEVICE

BACKGROUND OF THE INVENTION

1. Field of the Invention

The present invention relates to a sports swing training device used for training in golf swing and/or baseball bat swing.

2. Description of the Related Art

U.S. Pat. No. 4,614,343 discloses a golf swing training device comprising a grip and a shaft constructed similarly to those parts of a real golf club, and a head made in a unique construction different from that of a real golf club. This training device has a metal bar called click finger provided in a locked state in the head, so that the click finger is unlocked so as to fall and make a click sound when the centrifugal force of a swinging motion is higher than a predetermined level.

With the golf swing training device disclosed in the U.S. Pat. No. 4,614,343, however, the click finger is unlocked and makes a click sound whenever the centrifugal force generated by the swinging motion of a golf club is higher than a predetermined level even in an unsatisfactory form, it is not effective in correcting the swing form.

U.S. Pat. No. 5,634,856 discloses a sports swing training method and apparatus that has a weight housed freely movably in a tubular body. This training apparatus is designed so that the weight moves and strikes a distal end of the tubular body when the head portion reaches an impact point on a ball in a satisfactory swing form.

The sports swing training apparatus disclosed in the U.S. Pat. No. 5,634,856 employs a bar-shaped weight, however, and there has been such a problem that the sports swing training apparatus cannot be made in a shape similar to a real golf club or a baseball bat.

SUMMARY OF THE INVENTION

The present invention aims at solving the drawbacks of the golf swing training devices of the prior art, and provides a swing training device that enables it to reliably and easily acquire a good swing form of not only golf club but also baseball or softball bat.

The present invention also aims at providing a sports swing training device that can be made in a shape substantially similar to that of a real golf club or a baseball bat.

In order to achieve the object described above, as a first feature, the invention provides a sports swing training device that has a grip, a shaft and a head and can be used in the practice of golf club swing or bat swing of baseball or softball, wherein the head has a hollow space therein with the hollow space being partially filled with a liquid such as water or a solid material such as sand or pellets.

According to the first feature, the user can master the proper swing form of golf club or baseball or softball bat, while listening to the sound generated by the liquid or pellets that partially fill the hollow space and checking the position where the sound is produced.

The user can also correct the swing form by checking the sound generated during the swing and the position where the sound is produced.

In addition to the first feature described above, the sports swing training device of the invention has such a second feature that the device is formed similarly to a golf club as a whole, wherein the head of the club has a hollow space therein with the hollow space being partially filled with a liquid such as water or a solid material such as sand or small pellets.

According to the second feature, the invention enables it, in addition to the operation and effect of the first feature, to correct one's golf swing form by checking the sound generated by the liquid or pellets that partially fill the hollow space generated during the swing and the position where the sound is produced, while operating the sports swing training device in a similar way to that of a real golf club.

Although the sports swing training device cannot be used in an official game, one can use the sports swing training device as a golf club when playing on a golf course and correct one's swing form.

When used as a golf club, the sports swing training device can also provide secondary impact due to the liquid or solid material contained in the hollow space, in addition to the impact generated by the face of the club head.

In addition to the first feature described above, the sports swing training device of the invention has such a third feature that the device is formed like a baseball or softball bat as a whole, wherein the head portion of the bat has a hollow space therein with the hollow space being partially filled with a liquid such as water or a solid material such as sand or small pellets.

According to the third feature, the invention enables it, in addition to the operation and effect of the first feature, to correct one's bat swing by checking the sound generated during the swing and the position where the sound is produced, while operating the sports swing training device in a similar way to that of a real baseball or softball bat.

Although the sports swing training device cannot be used in an official game, one can use the sports swing training device as a real bat when playing in a practice game and correct one's batting form. When used as a bat, the sports swing training device also provides secondary impact due to the liquid or solid material contained in the hollow space when hitting a ball.

As a fourth feature of the invention, the sports swing training device is formed in a cylindrical or ring shape as a whole so as accommodate a baseball bat or a golf club fitted detachably in the central hole, while the cylindrical or ring-shaped body has a hollow inner space hollow space therein with the hollow space being partially filled with a liquid such as water or a solid material such as sand or small pellets.

According to the forth feature of the invention, with the sports swing training device attached to a baseball bat or a golf club freely detachably, the user can master the proper swing form of golf club or baseball or softball bat, while listening to the sound generated during the swing motion and checking the position where the sound is produced.

As a fifth feature, the invention provides a sports swing training device that has a grip, a shaft and a head and can be used in the practice of golf club swing or bat swing of baseball or softball, wherein whistles that sound when air flows therein are provided in the grip and the head, so that the whistle provided in the grip is caused to sound by air flow generated therein when the grip is moved down swiftly in down swing, and the whistle provided in the head is caused to sound by air flow generated therein when the head moves swiftly.

According to the fifth feature, the user can master the proper swing form of golf club or baseball or softball bat, by checking to see whether the whistles installed in the grip and in the head make sound or not and whether the sound is proper or not. The user can also check his or her swing form by listening to the sounds of the two whistles during the swing motion.

As a sixth feature of the invention, in addition to the fifth feature described above, the sports swing training device has the whistles installed in the grip and in the head that make different sounds.

According to the sixth feature, in addition to the operation and effect of the fifth feature, the user can check to see whether his or her down swing form and the trajectory of the head before impact are good or not by listening to the different sounds.

As a seventh feature of the invention, the sports swing training device is formed in a cylindrical or ring shape as a whole so as to accommodate a baseball bat or a golf club fitted detachably in the central hole, while the cylindrical or ring-shaped body has whistle that sounds when air flows therethrough.

According to the seventh feature, with the sports swing training device attached to a baseball bat or a golf club freely detachably, the user can easily master the proper swing form of golf club or baseball or softball bat, while listening to the different sounds of the whistle.

DETAILED DESCRIPTION OF THE PREFERRED EMBODIMENTS

Figure 1A:
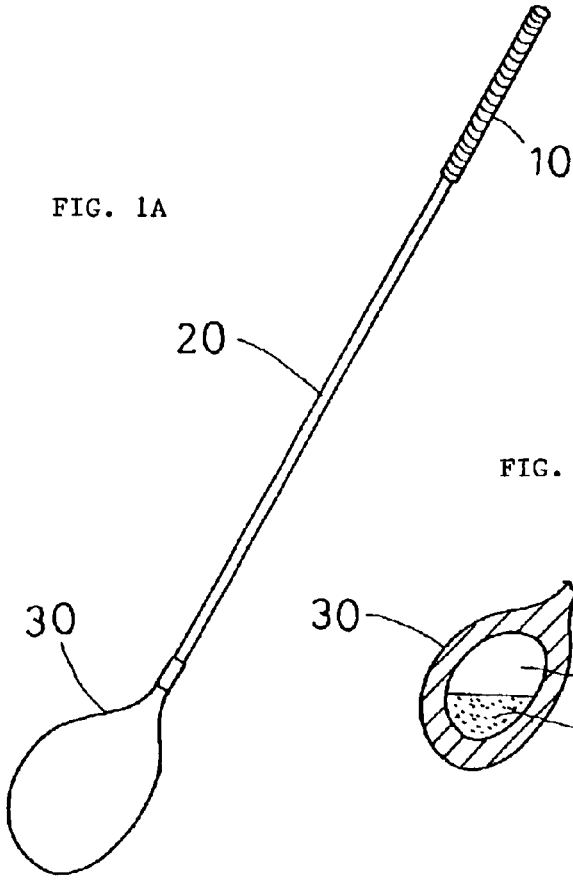
FIG. 1(A) in a perspective overview and FIG. 1(B) in a sectional view of a key portion.
Figure 1B:
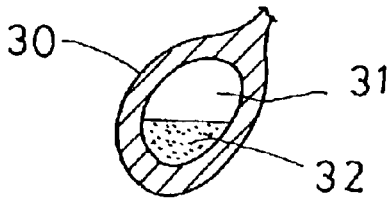
FIG. 1 shows a first embodiment of the sports swing training device of the invention.

The first embodiment shown in FIG. 1 will first be described below. Numeral 10 denotes a grip of the sports swing training device, 20 denotes a shaft and 30 denotes a head.

The head 30 has a hollow space 31 formed therein, with the hollow space 31 being partially filled with a content 32 comprising a solid material in the form of small pellets. The content 32 may be also a solid material such as sand or a liquid such as water.

The state of partial filling refers to the state of the content 32 filling the hollow space 31 not to the capacity thereof. Specifically, the content preferably occupies a half the capacity or a slightly smaller portion of the hollow space. This is because the spirit of the invention rests in that the head 30 work like the percussion instrument maraca through the combination of the hollow space 31 and the content 32.

In the first embodiment, the grip 10 and the shaft 20 have shapes and dimensions similar to those of a real golf club, and the head 30 also has a shape similar to that of the head of a golf club, so that the sports swing training device is similar to a golf club in shape, dimensions, weight and balance.

It is not necessary to make the head 30 in the same shape as the head of a real golf club, and the head 30 may simply be the distal end of the shaft 20 being expanded or have other shape, as long as the head has the hollow space that contains the content.

Figure 2:
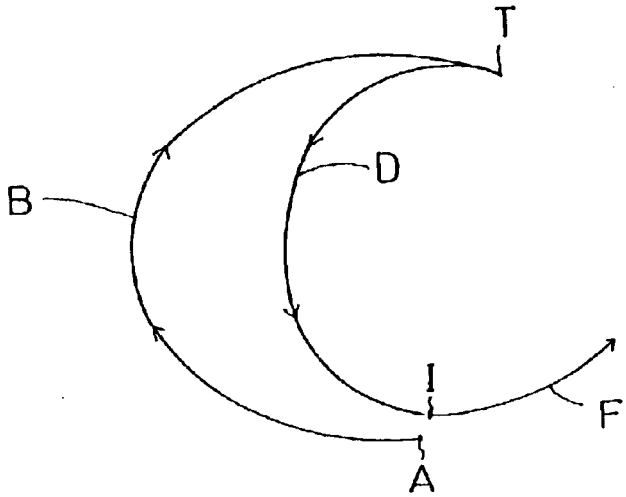
FIG. 2 shows a preferable trajectory of golf swing.

Taking reference also to FIG. 2 and FIG. 3, operation of the sports swing training device used in training of golf swing will be described below. The motion of golf swing generally consists of a sequence of addressing (A), back swing (B), top swing (T), down swing (D), impact (I) and follow through (F).

The back swing (B) forms a relatively large arc, as the shoulder, arms and the club move in coordination.

Figure 3:
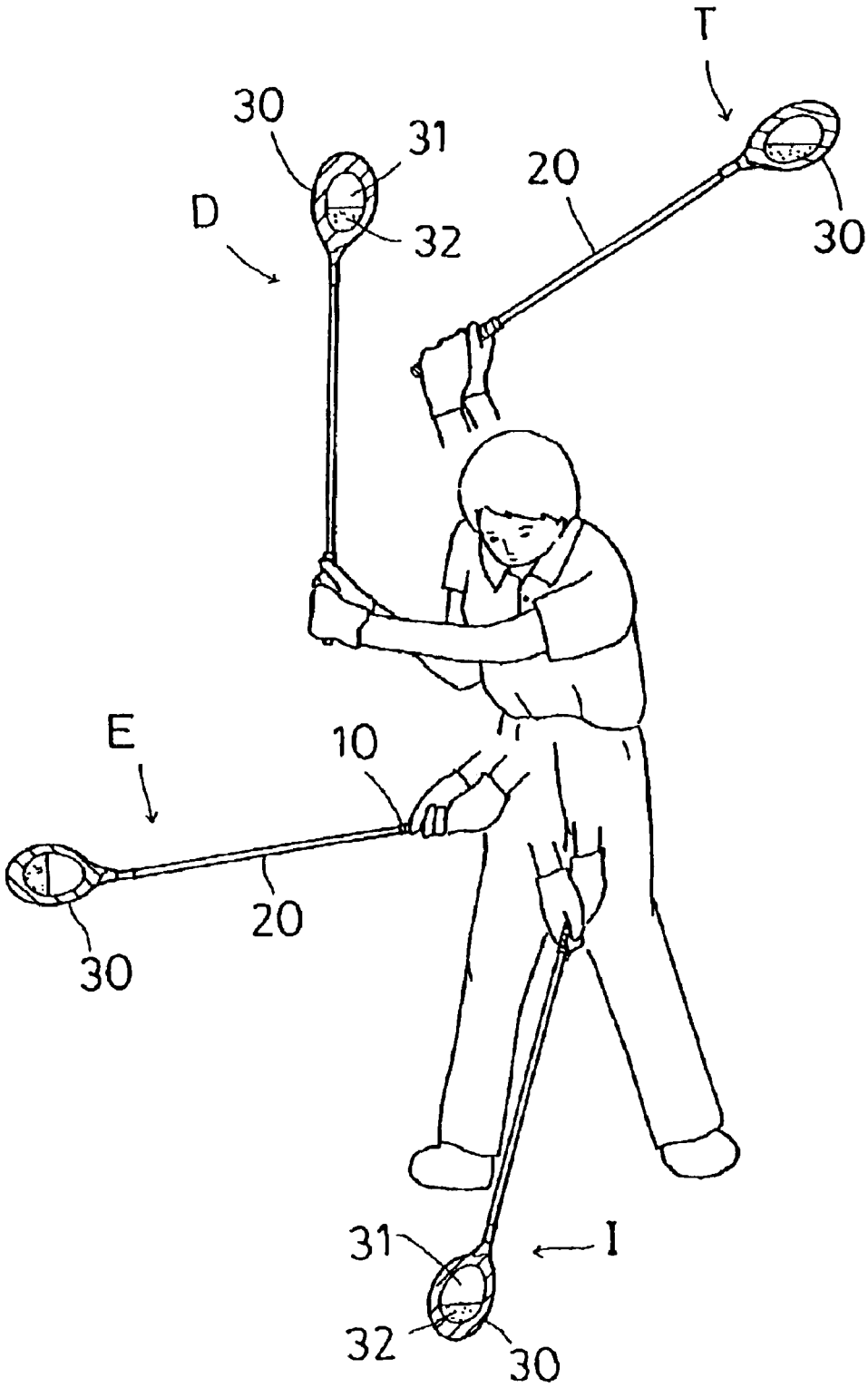
FIG. 3 explains a swing motion when the sports swing training device according to the first embodiment of the invention is used for training in golf swing.

During the down swing (D) that follows the top swing (T), it is said to be a good practice to pull down the shaft 20 while keeping the shaft in a vertical attitude as show in FIG. 3. When moving from the down swing (D) to the impact (I), the grip 10 is returned to the position of addressing (A), so that the head 30 is turned rapidly to impart a strong impact to the golf ball.

Positions of the sports swing training device in a desirable swing form are shown in FIG. 3.

In the path from the top swing (T) position to the down swing (D) position, the head 30 is directed vertically upward, and the shaft 20 is pulled down while keeping the shaft 20 in the vertical attitude, and therefore no centrifugal force is applied to the golf club till the down swing (D) position is reached. Thus during the desirable down swing motion, the content 32 provided in the hollow space 31 of the head 30 rests on the shaft 20 side due to the gravity that is predominant over the centrifugal force.

As the grip 10 is turned at a transitory position (E) between the down swing (D) and the impact (I), the head 30 moves swiftly resulting in a strong centrifugal force. Thus the content 32 moves quickly in the hollow space 31 from the shaft 20 side to the distal end so as to hit the inner surface on the distal end and make a sound. This action is similar to that of a maraca. That is, clear sound is produced only when the content 32 moves swiftly.

In case the user is a beginner incapable of swinging a golf club satisfactorily, he or she is likely to make a bad motion in the down swing (D) from the top swing (T) while keeping the shaft in vertical attitude, in a form called the hammer swing without keeping his or her arms tight on the body. In such a motion, the content 32 in the hollow space 31 of the head 30 begins, at the start of the swing, to move slowly due to the centrifugal force of the hammer swing that follows the top swing, until the content reaches the distal end of the hollow space 31 without making a clear sound. Thus the swing motion would be finished at the impact (I) without making a clear sound.

Therefore, the sports swing training device of the invention does not make a sound unless the sports swing training device is swung down in a correct motion of the down swing (D) from the top swing (T) to the impact (I) in a proper form.

Thus the user can acquire the proper swing form by correcting the motion until the sound is heard when the sports swing training device is swung down properly.

Figure 4A:
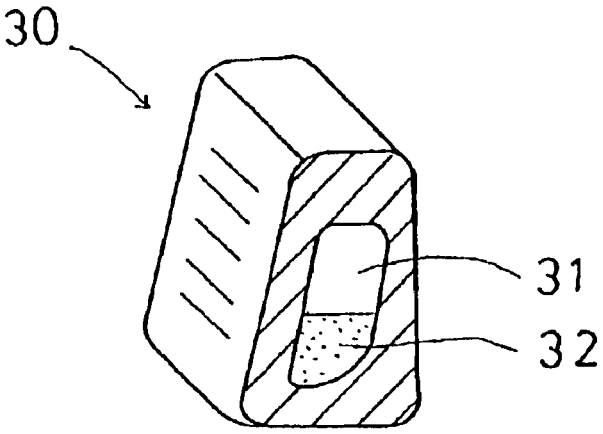
FIG. 4 shows variations of the first embodiment of the invention, FIG. 4(A), FIG. 4(B) and FIG. 4(C) showing partially cutaway views of key portions of the sports swing training devices.
Figure 4B:
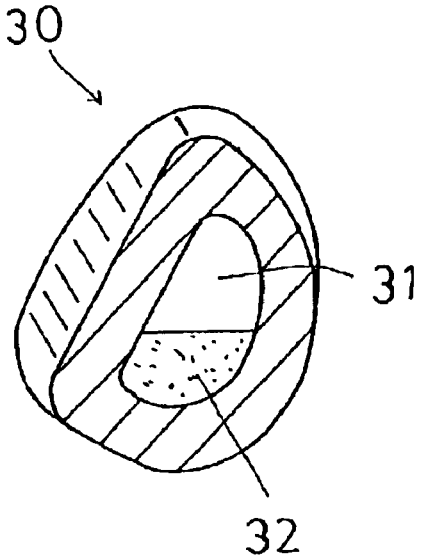
Figure 4C:
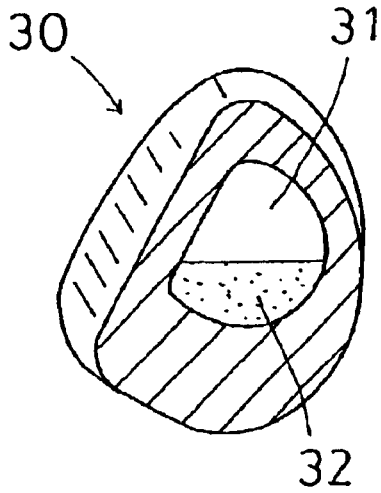

FIG. 4(A), FIG. 4(B) and FIG. 4(C) show variations of the first embodiment of the invention, where the head 30 as well as the grip 10 and the shaft 20 of the sports swing training device are made in appearances not distinguishable from those of a real golf club.

FIG. 4(A) shows the head 30 of the sports swing training device made similarly to the iron head of an ordinary golf club, while the hollow space 31 is formed in the head 30, with the hollow space being partially filled with the content 32 so that the sports swing training device can be used for training in the swing of iron club.

FIG. 4(B) shows the head 30 of the sports swing training device made similarly to the wood head of an ordinary driver club, while the hollow space 31 is formed in the head 30, with the hollow space being partially filled with the content 32 so that the sports swing training device can be used for training in the swing of wood club.

In case the head 30 as well as the grip 10 and the shaft 20 are made similarly to those of a real golf club, as described above, swing motion can be practiced by using the sports swing training device just in the same way as a real golf club. Although the sports swing training device cannot be used in an official game, one can enjoy playing on a golf course using the sports swing training device. In this case, the sports swing training device may well be called a golf club. The present invention includes the sports swing training device that can be used as a golf club, in the scope of the invention.

In case the sports swing training device is used as a golf club when playing on a course, the impact of the head 30 generated when hitting a ball can be enhanced by the content 32 provided in the hollow space 31. That is, when the head 30 hits the ball on the face thereof, the content 32 provided in the hollow space 31 hits the inner wall of the hollow space 31 on the face side by inertia, thereby imparting a secondary impact to the golf ball. This results in an increased flying distance of the golf ball.

The secondary impact can be increased by increasing the weight of the content, for example by using metal balls of higher specific gravity as the content 32.

FIG. 4(C) shows the head 30 of the sports swing training device made similarly to the wood head of an ordinary driver club similarly to FIG. 4(B), except for the hollow space 31 in the head 30 located higher than in the case of FIG. 4(B). By varying the vertical position of the hollow space 31 in this way, it is made possible to change the position of imparting the secondary impact to the golf ball when the content 32 hits the inner wall of the hollow space 31. Thus the take-off angle of the golf ball can be adjusted.

Figure 5A:
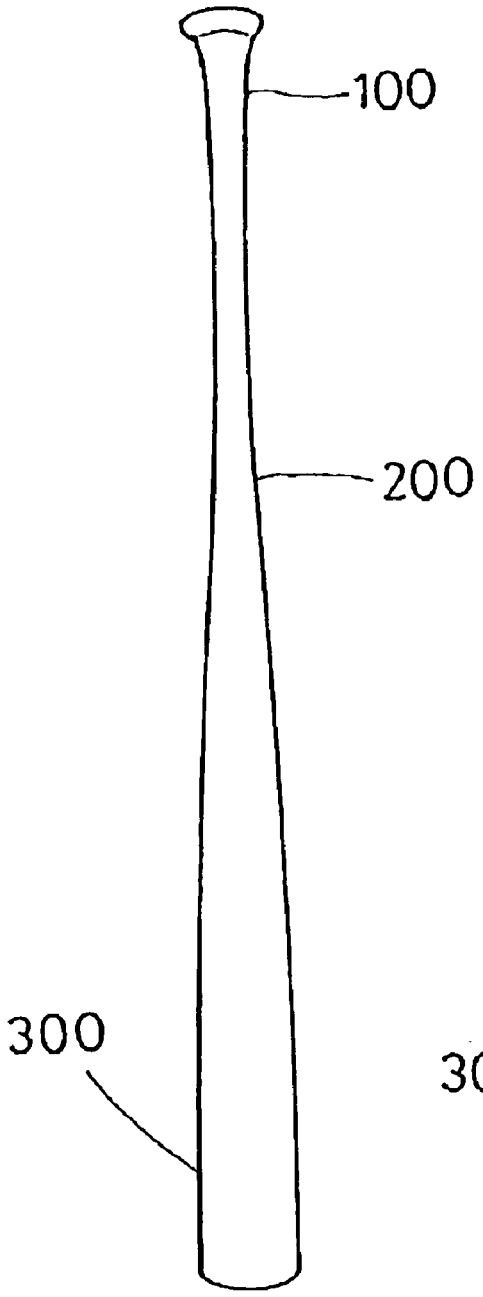
FIG. 5 shows a second embodiment of the sports swing training device of the invention, FIG. 5(A) showing an overview and FIG. 5(B) showing a sectional view of a key portion.
Figure 5B:
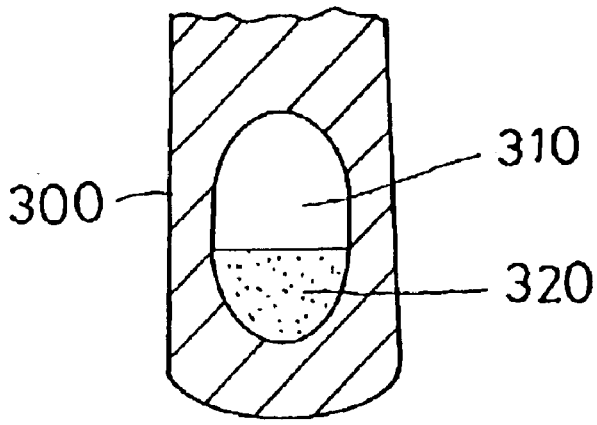

FIG. 5 shows the second embodiment of the sports swing training device of the invention. The sports swing training device according to this embodiment comprises a grip 100 similar to the grip of a bat, a shaft 200 similar to the middle portion of a bat and a head 300 similar to the head portion of a bat, in a constitution similar to that of a baseball or softball bat as a whole.

The head 300 has a hollow space 310 formed therein, with the hollow space 310 being partially filled with a content 320 comprising small pellets. The content 320 may be either a solid material such as sand or a liquid such as water.

Swing motion of a bat has a common factor with the golf swing, and it is said that good practice is to pull down the bat (shaft 200) from the top position (waiting position of the bat ready for swing) while being directed vertically upward, followed by turning of the grip so as to move the head 300, thereby imparting a strong impact to the ball.

Thus during the desirable down swing motion and the turning of the grip, the head 300 of the bat moves swiftly resulting in a strong centrifugal force at a transitory position between the down swing and the impact. At this time, the content 320 moves swiftly from the shaft 200 side to the distal end in the hollow space 310, and hits the inner wall at the distal end so as to make sound.

In the case of a swing form called the hammer swing carried out without with keeping his or her arms tight on the body, the content 320 moves slowly within the hollow space 310 from the start of swing toward the distal end, without with making a clear sound when the impact position is reached.

Thus the user can acquire the proper form of bat swing by correcting the motion until a clear sound is heard when the impact position is reached.

The training device for bat swing may also have a slender grip and a slender shaft similar to those of a golf club, although the head must be concentric with the shaft at the distal end of the shaft. The head must not be eccentrically connected with the shaft as in a golf club.

Figure 6A:
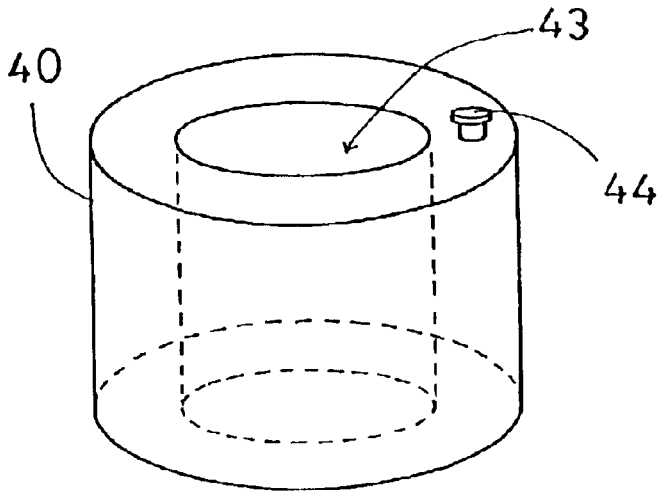
FIG. 6 shows a third embodiment of the sports swing training device of the invention, FIG. 6(A) showing an outside appearance and FIG. 6(B) showing a sectional view.
Figure 6B:
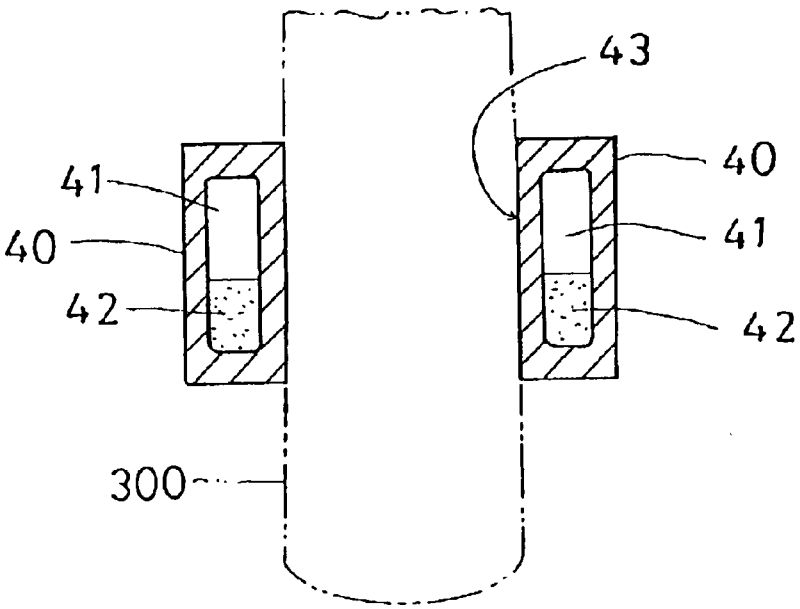

FIG. 6(A) and FIG. 6(B) show the third embodiment of the sports swing training device of the invention. This embodiment provides a simplified sports swing training device, that is fitted detachably on a bat for use in a waiting circle or other places for the purpose of training in bat swing.

The sports swing training device is formed in a cylindrical or ring shape as a whole and the body 40 has a central hole 43 that accommodates a bat near the head portion 300 of the bat, with a hollow space 41 formed in the body 40. The hollow space 41 is partially filled with a liquid such as water. The content 42 may also be a solid material such as sand or small pellets. The body 40 may have a capped charging port 44 through which the hollow space 41 can be filled with the content 42 or emptied. The charging port 44 enables it to fill the hollow space 41 with the content 42 such as water when necessary, and empty the content 42 when unnecessary. Weight of the bat can also be changed by adjusting the quantity of the content 42.

When the simplified sports swing training device of this embodiment is fitted near the head 300 of a bat and used in the practice of bat swing, a sound is generated at the position of impact in a good swing, similarly to the case of the second embodiment described in conjunction with FIG. 5. Thus the user can correct his or her swing form into a proper form, and verify the swing form.

Figure 7:
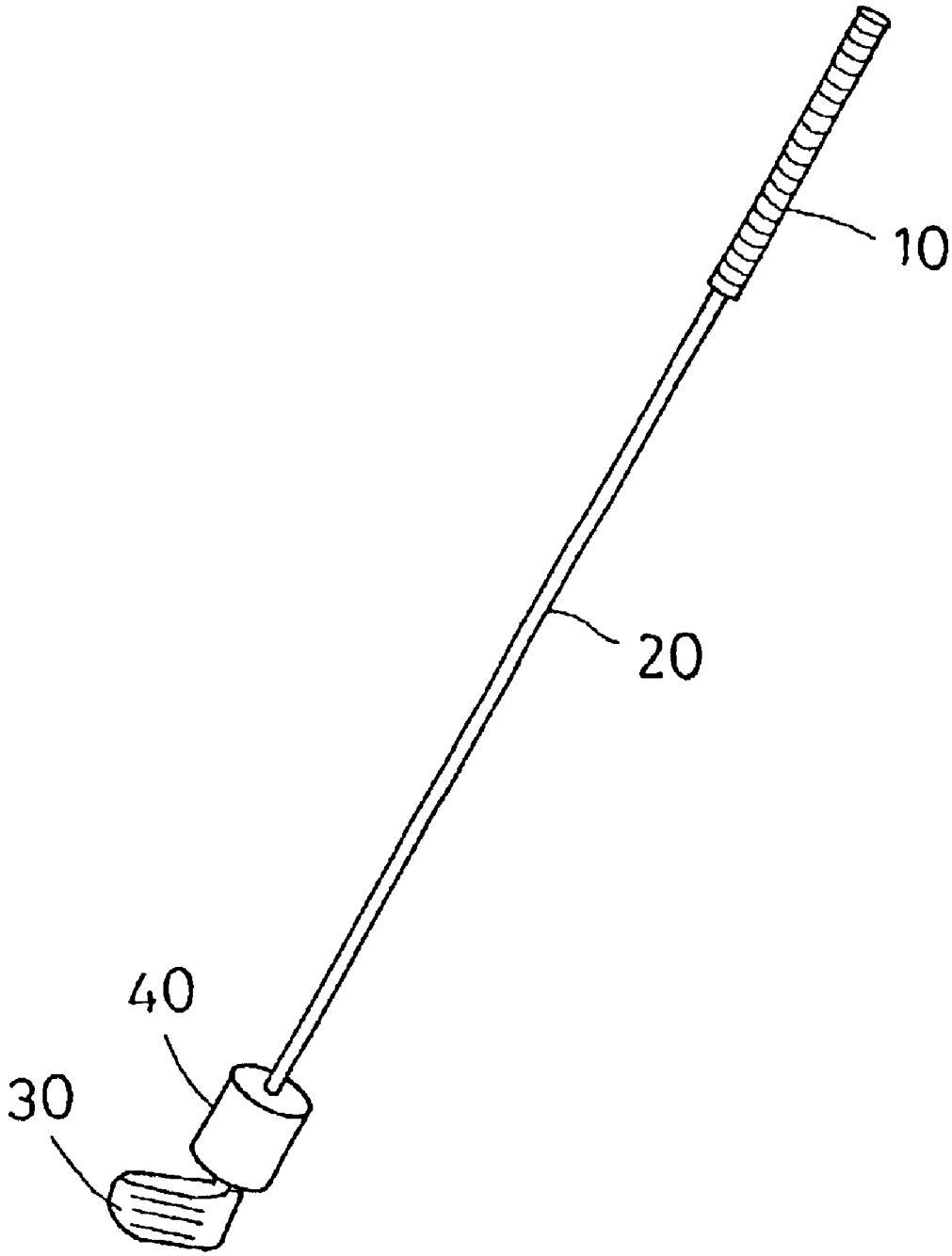
FIG. 7 shows a variation of the third embodiment of the invention in an overview of the sports swing training device being attached to a golf club.
Figure 8:
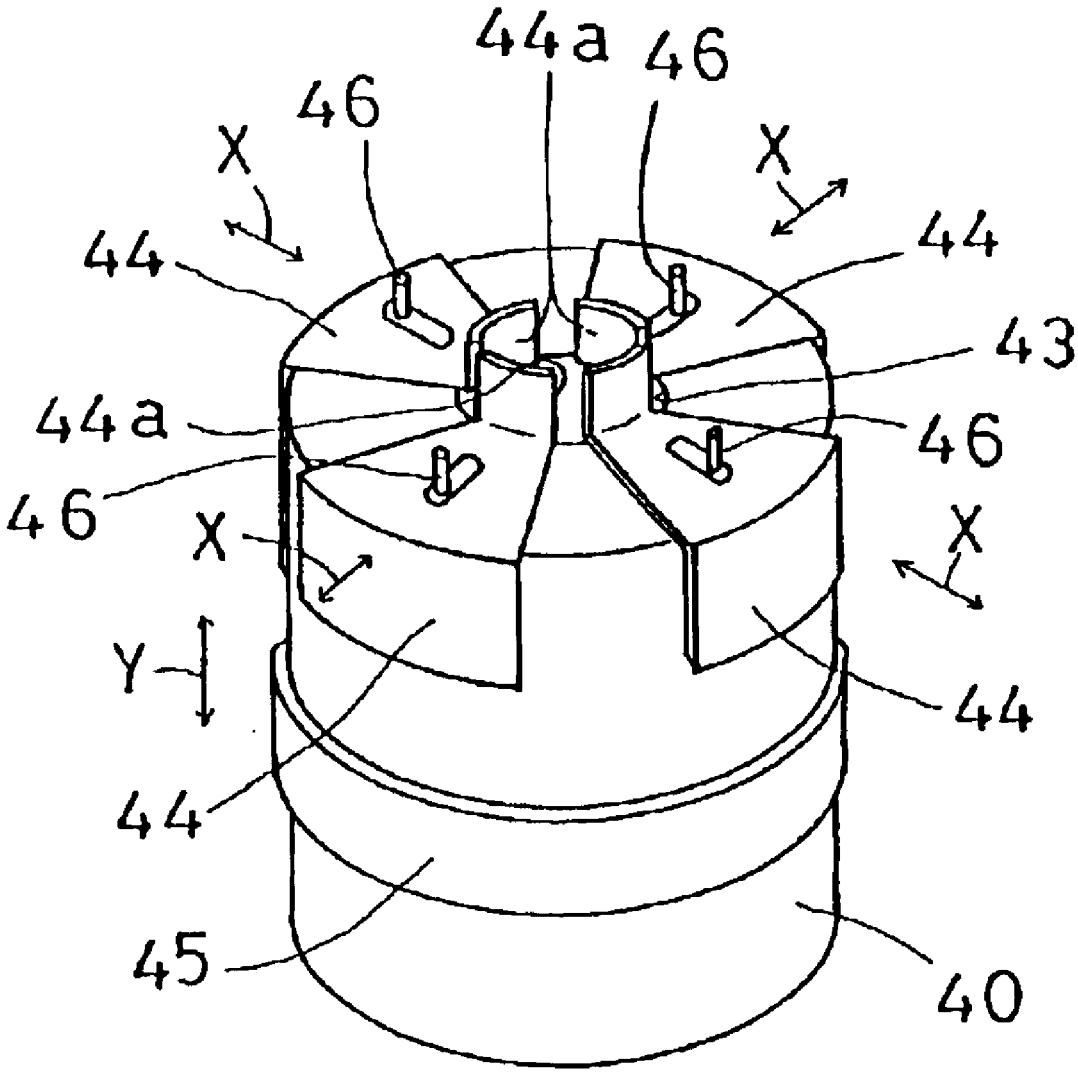
FIG. 8 is a detailed drawing of the sports swing training device shown in FIG. 7.

FIG. 7 and FIG. 8 show variations of the simplified sports swing training device according to the third embodiment of the invention described in conjunction with FIG. 6. This embodiment is a simplified sports swing training device that can be attached on a golf club, at the distal end of the shaft 20 near the base of the head 20 as shown in FIG. 7, and used for training in golf swing.

Similarly to that shown in FIG. 6, the body 40 formed in cylindrical or ring shape has a hollow space, that is not shown, with the hollow space being partially filled with a liquid such as water not shown, and the central hole 43 to accommodate a golf club.

The body 40 has clamp pieces 44 and clamp rings 45 shown in FIG. 8, for example, as means for fastening the body on the shaft 20 of the golf club. The clamp pieces 44 are provided in plurality (four in the drawing) in such a constitution as can be moved in the radial direction (X direction) toward and away from the shaft 20 that is fitted in the central hole 43. Clamping effect can be made more reliable by making the bearing portions 44*a* of the clamp pieces 44, that contact with the shaft 20, from rubber. Numeral 46 denotes stoppers for the clamp pieces 44.

With the clamp pieces 44 being pressed against the shaft 20 from around, the clamp rings 45 are moved in the axial direction (Y direction) thereby to fasten the clamp pieces 44 on the body 40.

The means for fastening the body 40 on the shaft 20 is not limited to the clamp pieces 44 and the clamp rings 45.

Such a constitution may also be employed as hollow space (31, 310) and content (32, 320) are provided also in the grip (10, 100) as well as in the head (30, 300). This constitution makes such an effect as a sound is made by the content (32, 320) hitting in the grip (10, 100) during the down swing and another sound is generated by the content (32, 320) in the head (30, 300) near the impact point, when the golf club or bat is swung in a proper form.

Figure 9A:
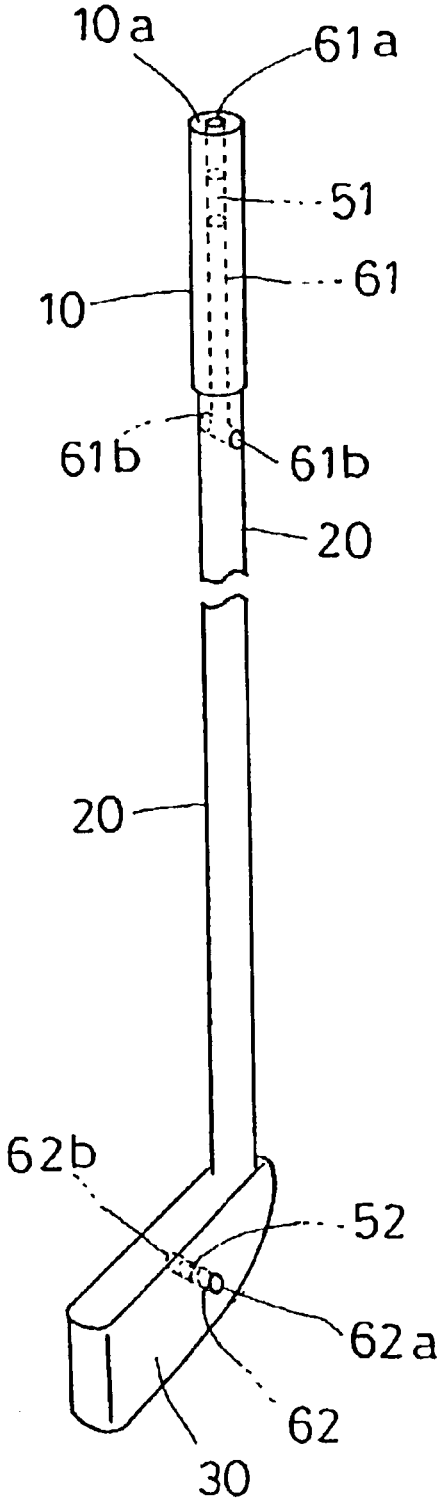
FIG. 9 shows a fourth embodiment of the sports swing training device of the invention, FIG. 9(A) showing an overview of a golf swing training device and FIG. 9(B) showing an overview of a sports swing training device for baseball or softball.
Figure 9B:
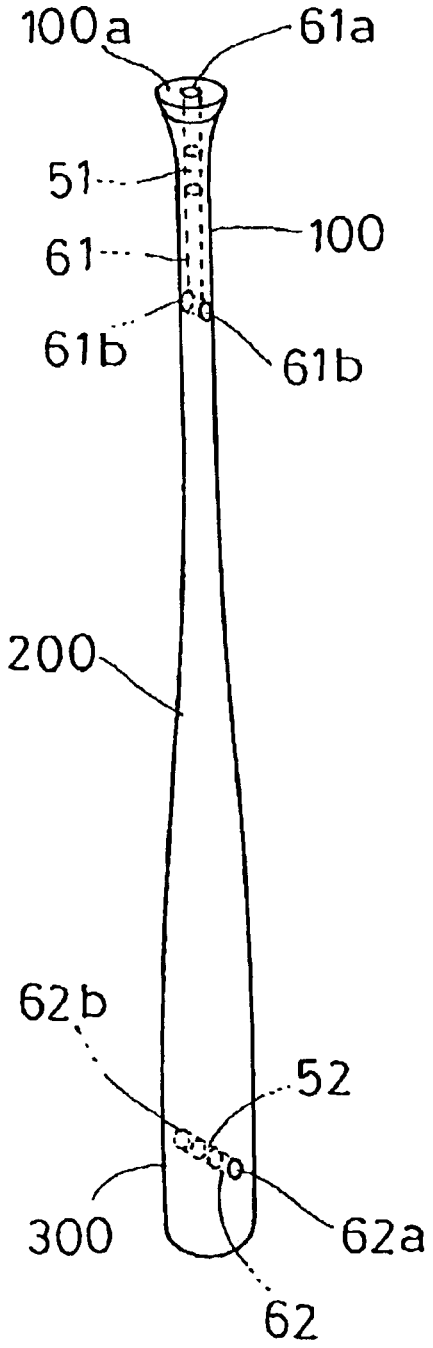

FIG. 9 shows a fourth embodiment of the sports swing training device of the invention, (A) showing the sports swing training device furnished as a sports swing training device for golf, comprising a main body made in the shape of a golf club as a whole that has a grip 10, a shaft 20 and a head 30, wherein whistles 51, 52 are provided in the grip 10 and the head 30. FIG. 9(B) shows the sports swing training device furnished as a bat swing training device for baseball or softball, comprising a main body made in the shape of a bat as a whole that has a grip 100, a shaft 200 and a head 300, wherein whistles 51, 52 are provided in the grip 100 and in the head 300.

The whistles 51, 52 are made so as to sound when air flows therethrough. The whistles 51, 52 can be provided in the grip 10 and the head 30, and in the grip 100 and the head 300, respectively.

When the sports swing training device having the shape of golf club or baseball bat having the whistle 51 provided in the grip 10, 100 is swung, a sound is generated by air introduced through the end of grip 10*a*, 10*a* and flowing through the whistle 51, as the grip 10, 100 is moved swiftly downward with the end of the grip 10*a*, 100*a* directed downward. For example, such a constitution may be employed as an aperture 61*a* is formed in the grip 10*a*, 100*a* so as to form an air passage 61 in the grip 10, 100, while the whistle 51 is installed amid the air passage, so that the air that has passed through the whistle 51 flows through the aperture 61*b* to the outside. The whistle 51 is adjusted in advance so as to make sound only when the grip 10, 100 is moved swiftly downward with the end of the grip 10*a*, 100*a* directed downward.

When the sports swing training device having the shape of golf club or baseball bat having the whistle 52 provided in the head 30, 300 is swung, a sound is generated by air flow generated as the head 30, 300 is moved swiftly.

In the case of the sports swing training device having the shape of golf club, such a constitution may be employed as apertures 62*a*, 62*b* are formed in the head 30 so as to form an air passage 62 that penetrates the head in the direction of swing, while a whistle 52 is installed in the air passage 62. The whistle 52 may also be fixed on the outside of the head 30 so as to allow the air to pass in the direction of swing.

In the case of the sports swing training device having the shape of baseball bat, such a constitution may be employed as the aperture 62*a* is formed in the side face of the head 300 so as to form the air passage 62 in the head 300, while the whistle 52 is installed in the air passage 62. The air that has passed through the whistle 52 is caused to flow out of the bat through another side face 62*b* of the head 300 or the distal end of the head 300. The aperture 62*a* provided on the side face of the head 300 may also be provided in plurality around the head 300 as air inlet holes. The whistle 52 attached on the head 300 of the bat may be provided in plurality around the head 300 so that the bat can be held at any angular position around the axis.

With the whistles 51, 52 provided in the grip 10, 100 and the head 30, 300 as described above, the whistle 51 sounds as proper air flow passes through the whistle 51 when proper down swing is made. When the head 30, 300 is moved swiftly following the proper down swing, the whistle 52 sounds due to air flow therethrough. The whistle 51 does not sound when the down swing is not made properly. The whistle 52 does not sound also when the head 30, 300 is not moved swiftly.

The sound of the whistle 51 provided in the grip 10, 100 and the sound of the whistle 52 provided in the head 30, 300 may be made different from each other, such as sounds of different tones. With the different sounds, wrong portion of the swing form can be identified.

Figure 10:
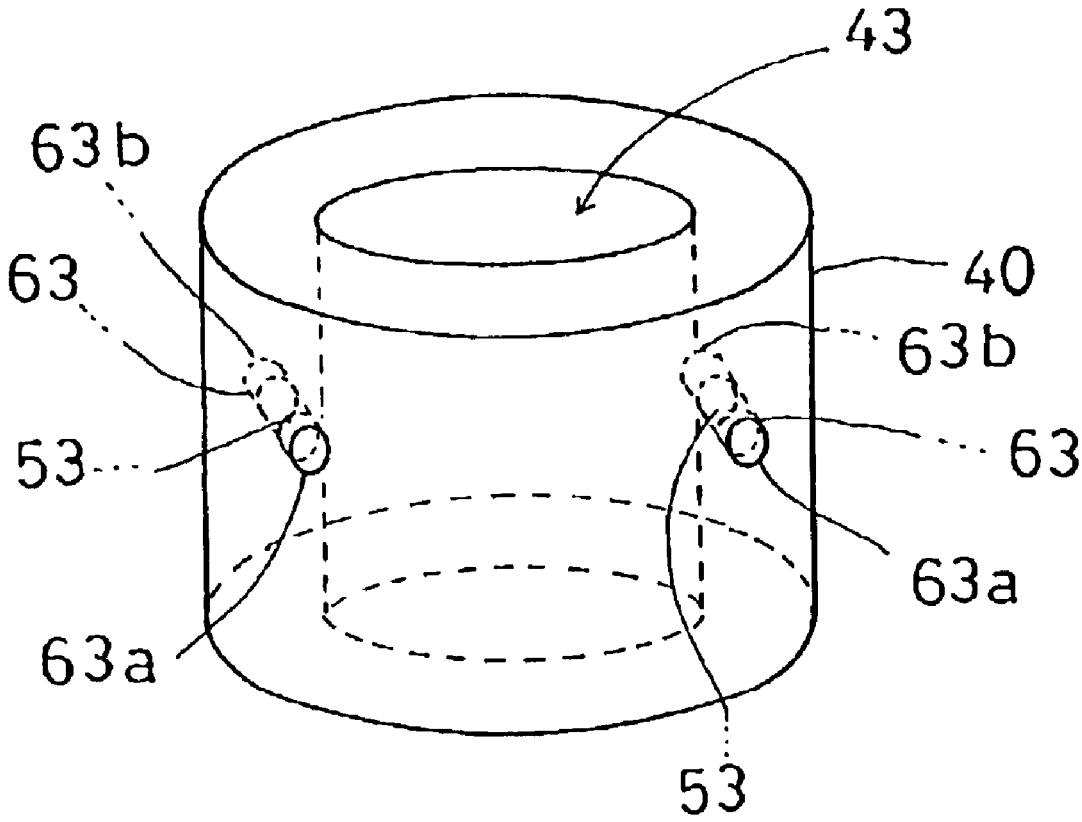
FIG. 10 shows an outside appearance of a fifth embodiment of the sports swing training device of the invention.

FIG. 10 shows a fifth embodiment of the sports swing training device of the invention. This embodiment provides a simplified sports swing training device similar to that described in conjunction with FIG. 6, that is fitted detachably on a baseball bat for use in a waiting circle or other places for the purpose of training in bat swing.

The sports swing training device of this embodiment comprises a body 40 that is formed in a cylindrical or ring shape as a whole and has a central hole 43 that accommodates a bat near the head portion 300 of the bat fitted therein, while a whistle 53 is provided in the body 40. By providing apertures 63*a*, 63*b* in the body 40, one or more air passage 63 is formed so as to penetrate the body 40 horizontally, with the whistle 53 being installed in the air passage 63. One or more whistle 53 may also be attached on the outside of the head 40, so that air passes through the whistle 53 horizontally.

When the simplified sports swing training device constituted as described above attached to a bat is used in practicing bat swing, an effect similar to that of the fixed whistle 52 shown in FIG. 9(B) can be expected from the whistle 53 of this simplified sports swing training device.

It needs not to say that the simplified sports swing training device shown in FIG. 10 can also be used while being attached to the grip 100 of the bat, by varying the dimensions and shape. In this case, such a constitution may be employed as the body 40 is made in a shape that allows it to be freely detachably attached to the grip 100, and the whistle 53 is attached to the body 40 so that the air flows through the whistle in the axial direction of the grip 100 (so as to operate similarly to the whistle 51 shown in FIG. 9(B)).

The simplified sports swing training device may also be adapted for golf club. In this case, such a constitution may be employed as the shape of the body 40 shown in FIG. 10 is changed to a shape and mechanism that allow it to be freely detachably attached near the head 30 of a golf club, and the whistle 53 is attached to the body 40 so that the air flows through the whistle in the direction of golf swing (so as to operate similarly to the whistle 52 shown in FIG. 9(A)). When the sports swing training device is used while being attached to the grip 10 of a golf club, such a constitution may be employed as the body 40 is made in a shape and mechanism that allow it to be freely detachably attached to the grip 10 of the golf club, and the whistle 53 is attached to the body 40 so that the air flows through the whistle in the axial direction of the grip 10 (so as to operate similarly to the whistle 51 shown in FIG. 9(A)).

What is claimed is:

1. A sports swing training device formed in a cylindrical shape with a central hole to accommodate a baseball bat or a golf club, said central hole being suitable for detachably engaging the shaft portion of an associated baseball bat or golf club wherein the cylindrical-shaped body is self-supporting and has a hollow space formed therein that is partially filled with a liquid or a solid material, whereby a distinct sound is generated at a position of impact when said material moves quickly in the hollow space from a proximal end to a distal end and hits an inner surface on the distal end and thereby achieves audible support for operation of the swing training device.

2. A sports swing training device suitable for use with a baseball bat or a golf club, said device comprises;

a cylindrical or ring shaped body with a central hole, said central hole being suitable for detachably engaging the shaft portion of an associated baseball bat or golf club, said cylindrical or ring shaped body includes a hollowed out internal enclosure, said enclosure being suitable for retaining a liquid, or alternatively, a solid material, said device further comprises plural clamp pieces, with each of said clamp pieces contoured to matingly contact an external segment of said body as well as a portion of the shaft of an associated baseball bat or golf club, said clamp pieces include means for controlled radial movement along the cylindrical or ring shaped body and thereby provides a clamping effect to insure integral contact between the sports swing training device and an associated baseball bat or golf club.

3. A sports training device according to claim 2, wherein the cylindrical or ring shaped body further comprises at least one distinct clamping ring adapted for controlled axial rotation and thereby provide an added clamping effect between the sports swing training device and an associated baseball bat or glove.

* * * * *